United States Patent [19]

Baumker, Jr.

[11] Patent Number: 4,704,829

[45] Date of Patent: Nov. 10, 1987

[54] BUILDING TRUSS CLAMP DEVICES

[76] Inventor: Andrew J. Baumker, Jr., 2152 S. Jenkins Ave., Ft. Pierce, Fla. 33451

[21] Appl. No.: 19,742

[22] Filed: Feb. 27, 1987

[51] Int. Cl.[4] ..... E04C 3/11

[52] U.S. Cl. ..... 52/127.2; 269/43; 33/613; 52/696

[58] Field of Search ..... 52/696, 127.2, 749; 269/43; 33/613

[56] References Cited

U.S. PATENT DOCUMENTS

| | | | |
|---|---|---|---|
| 2,153,893 | 4/1939 | Johanson | 269/43 |
| 2,686,959 | 8/1954 | Robinson | 269/43 |
| 2,964,807 | 12/1960 | Kennedy | 52/696 |
| 2,978,770 | 4/1951 | Tatsch | 52/127.2 |
| 3,083,007 | 3/1963 | Campfield | 33/613 |
| 3,170,244 | 2/1965 | Johansson | 33/613 |
| 3,959,945 | 6/1976 | Allen | 52/696 |
| 4,322,064 | 3/1982 | Jarvis | 269/43 |
| 4,420,921 | 12/1983 | Hardin | 33/613 |

FOREIGN PATENT DOCUMENTS

| | | | |
|---|---|---|---|
| 6552 | 7/1928 | Australia | 52/127.2 |

*Primary Examiner*—William F. Pate, III
*Assistant Examiner*—Caroline D. Dennison
*Attorney, Agent, or Firm*—Carroll F. Palmer

[57] ABSTRACT

A clamp device to hold building trusses in place after the trusses have been deposited upon a building foundation by a crane and while they are being nailed to stabilize their position prior to application of building panels thereto include a pair of substantially identical first U-shaped strip members positioned spaced apart parallel to one another with lateral portions at each end being aligned with each other. Spaced apart cross-ties fix the first members in such position and a second U-shaped strip member similar in configuration to the first members is captured between the first members by the cross-ties to move parallel thereto with lateral portions of the second member projecting from the same side of the device as the lateral portions of the first members. A levered cam unit effects relative, parallel movement between the first and second members to clamp and unclamp the device to building trusses.

5 Claims, 4 Drawing Figures

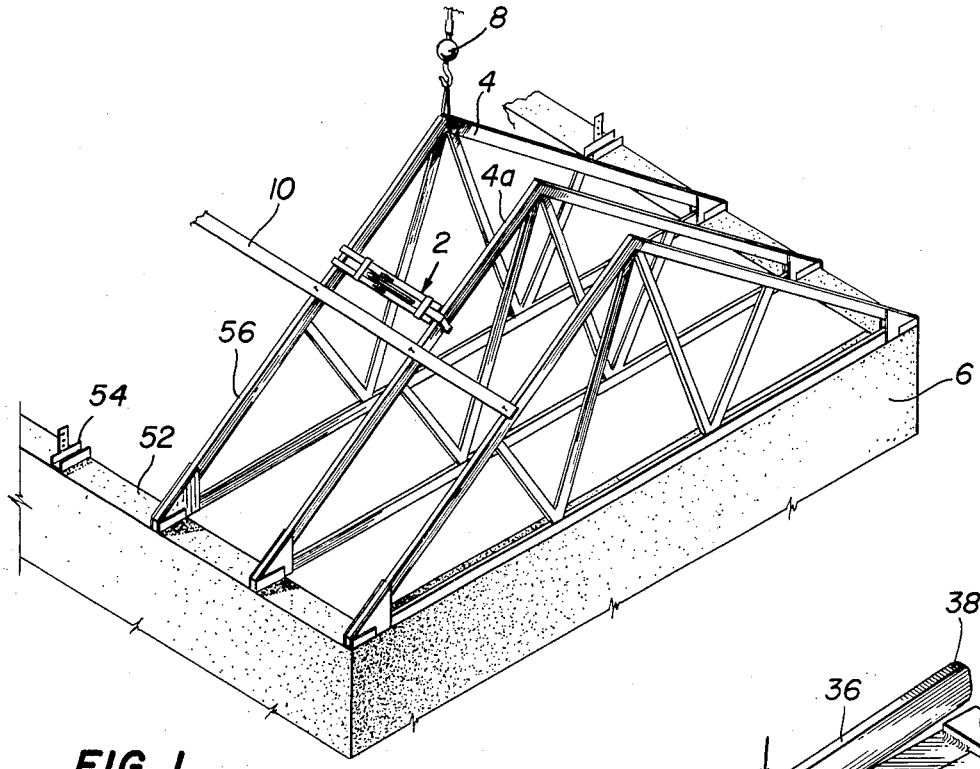
FIG. 1
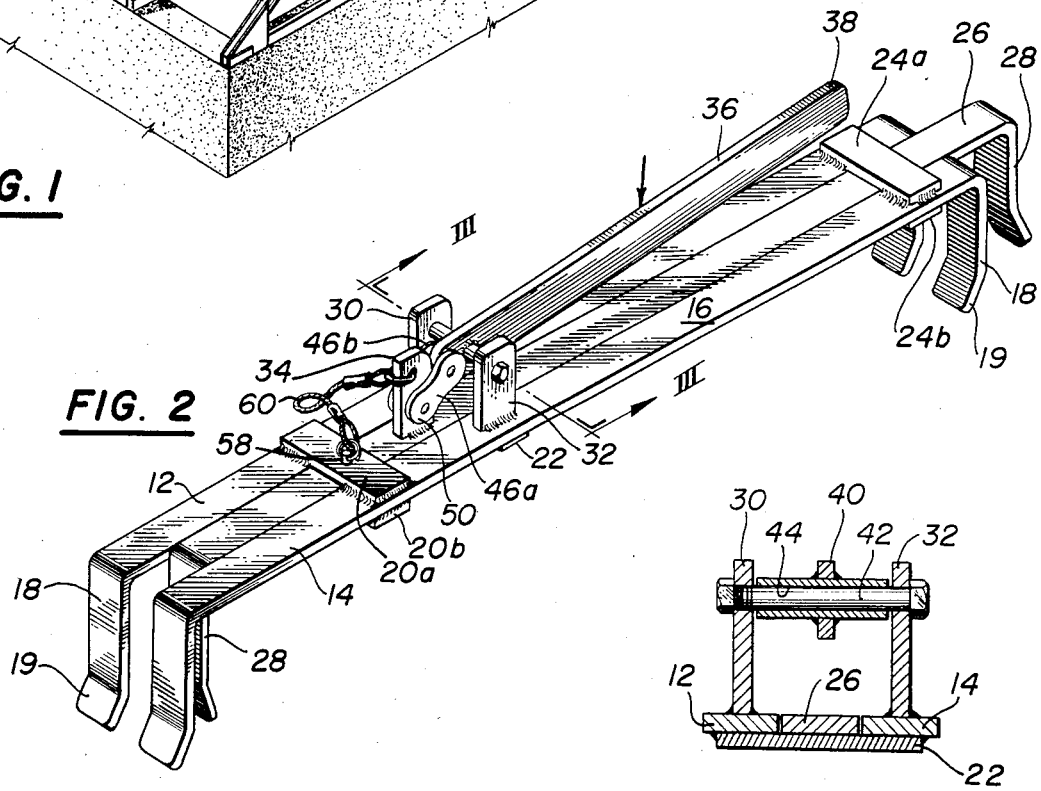
FIG. 2
FIG. 3
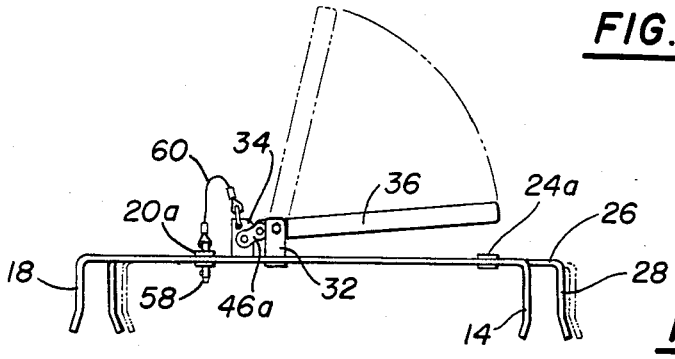
FIG. 4

BUILDING TRUSS CLAMP DEVICES

BACKGROUND OF THE INVENTION

1. Field of the Invention

This invention relates to clamp devices to hold and space building elements. More particularly, it concerns clamp devices designed to hold building trusses in place after the trusses have been deposited upon a building foundation by a crane and while they are being nailed to stabilize their position for further work thereon.

2. Description of the Prior Art

In the construction of residental homes and other buildings that use wooden trusses as components of the roofing, it is conventional practice to have such trusses preformed at a separate location and then trucked to the building site. Then, after the building foundation, including walls and perimeter beam, has been built, a crane is usually employed to lift the trusses, one at a time, from their ground storage location up onto the perimeter beam. Typical trade practice then involves having the crane remain in a support position while a carpenter nails the truss to a horizontal spacer timber in order to stabilize it so the crane can move away to pick up another truss for repetition of the positioning and stabilizing operation.

In such construction operations, cranes are conventionally charged by the hour, so that the greater the number of trusses that can be installed per hour, the lower the labor and equipment costs will be to the contractor. The present invention relates to devices that can effectively reduce the time required for a crane and its operator to set wooden trusses onto a building foundation.

The use of spacing clamps and tools in building construction is not new, e.g., see U.S. Pat. Nos. 2,567,586; 2,686,959; 3,201,874; 4,322,064 and 4,420,921. The present invention extends the art of use of spacing clamps by providing new forms of clamp devices and new methods of clamp usage in installation of trusses in the construction of buildings.

OBJECTS

A principal object of the invention is the provision of new forms of building truss clamp devices.

Further objects include the provision of:

1. New clamp devices designed to hold building trusses in place after the trusses have been deposited upon a building foundation by a crane and while they are being nailed to stabilize their position for further work thereon.

2. New methods for positioning and stabilizing preformed roof trusses in the construction of buildings.

3. New clamp devices designed to improve the efficiency of operation of cranes at building sites.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of new forms of clamp devices to hold building trusses in place after the trusses have been deposited upon a building foundation by a crane and while they are being nailed to stabilize their position prior to application of roofing sheets or like building panels thereto.

The new truss clamp include a pair of substantially identical first U-shaped strip members defined by a longitudinal base portion and a lateral portion at each end thereof. Such first members are positioned spaced apart parallel to one another with their lateral end portions aligned with each other.

Spaced apart cross-ties fix the first members in such parallel position and a second U-shaped strip member similar in configuration to the first members is captured between the first members by the cross-ties to move parallel thereto. Lateral end portions of the second member project from the same side of the device as the lateral portions of the first members.

Short posts extend laterally of the first members and the second member from the sides thereof opposite to their lateral portions. Such lateral posts of the first members lie in a common plane normal to the longitudinal axes of the first members while the lateral post of the second member is spaced apart from the lateral posts of the first members.

A lever arm with a free end and a captured end is pivoted adjacent its captured end on a shaft that extends between the lateral posts of the first members and a pair of cam elements are pivoted at one end to the captured end of the lever arm and at the other end to the lateral post of the second member. Movement of the lever arm effects relative movement of the first and second members of the clamp to clamp and unclamp it from building trusses.

BRIEF DESCRIPTION OF THE DRAWINGS

A more complete understanding of the invention may be had by reference to the accompanying drawings in which:

FIG. 1 is a perspective view of building trusses being installed on a building foundation with the aid of new truss clamp devices of the invention.

FIG. 2 is an isometric view of a building truss clamp device constructed in accordance with the invention.

FIG. 3 is a sectional view taken on the line III—III of FIG. 2.

FIG. 4 is a lateral view of the device of FIG. 2 illustrating its clamping and unclamping operation.

DESCRIPTION OF THE PREFERRED EMBODIMENTS

Referring in detail to the drawings, in which identical parts are identically marked, the invention comprises a clamp device 2 to hold building trusses 4 in place after the trusses have been deposited upon a building foundation 6 by a crane 8 and while they are being nailed to a horizontal cross timber 10 to stabilize their position prior to application of roofing panels (not shown) thereto.

The device 2 has a pair of left and right, first U-shaped strip members 12 & 14 defined by a longitudinal base portion 16 and a lateral portion 18 at each end thereof. The first members 12 & 14 are positioned spaced apart and parallel to one another with their lateral end portions 18 aligned with each other on the same side of the base portion 16. The free ends 19 flair longitudinally of their respective lateral portions 18.

Spaced apart cross-ties 20*a*, 20*b*, 22, 24*a* & 24*b* fix members 12 & 14 in parallel position. A second U-shaped strip member 26 is captured between the members 12 & 14 by the cross-ties 20*a* etc. to move parallel thereto with the lateral portions 28 of the member 26 projecting from the same side of the device 2 as the lateral portions 18.

Lateral posts 30, 32 & 34 extend laterally respectively of the members 12, 14 & 26. Lateral posts 30 & 32 lie in a common plane normal to the longitudinal axes of the members 12 & 14 and the lateral post 34 is spaced apart therefrom.

Advantageously, the members 12, 14, & 26 are made of strap steel. So are cross-ties 20*a* etc. made of like strap steel and are welded to such members.

A lever arm 36 with a free end 38 is pivoted adjacent the captured end 40 on a shaft 42 that extends between the lateral posts 30 & 32. Shaft 42 is journalled in the tube 44 welded to the arm 36.

A pair of cam elements 46*a* & 46*b* are pivoted at one end 48 to arm end 40 and at the other end 50 lateral post 34.

In use of the new clamps 2, a crane 8 will pick up a truss 4 from a storage pile (not shown), lift it and lower it as shown in FIG. 1 onto the perimeter beam 52 of building 6. Immediately, the clamp 2 is applied by a workman (not shown) to properly space the truss 4 from the previously position truss 4*a*. The ties 54 are cast in the perimeter beam 52 at proper spaced distances, e.g., 24" centers, and as the crane 8 lowers the truss 4, its lower ends 56 become fixed the required distance from the prior truss 4*a*. Promptly, the clamp 2 is positioned on and between the trusses 4 & 4*a* and the arm 36 is raised to move the member 26 so its lateral portions 28 close toward the lateral portions 18 of member 12 & 14. This temporarily fixes the truss 4 at the proper distance from truss 4*a* which, in turn, permits the operator of crane 8 to move it back to the truss supply pile while a workman nails cross timber 10 to the truss 4 to retain it in proper spaced position until sheeting panels (not shown) or the like are applied. Operating in this manner with the new truss clamps 2 of the invention, a crane 8 and its operator (not shown) can double the hourly output of installed trusses. Hence, the cost of roofing of building 6 can be substantially reduced with the use of a relatively inexpensive item, namely, the truss clamp of the invention.

As a safety feature to protect workmen using the new clamps 2, a "quick" pin 58 may be used to prevent accidental opening of the clamp portions 18 & 28 when the clamp 2 is clamped to a pair of trusses 4. The pin will extend through mating holes (not numbered) in the cross-ties 20*a* & 20*b* and the second strip member 26. A lanyard 60 is provided to secure the pin 58 against loss when removed (not shown) from the clamp 2 to permit the lever arm to be raised, as shown in phantom in FIG. 4, to open the clamp for repositioning on further pairs of trusses 4.

The embodiments of the invention in which an exclusive property or privilege is claimed are defined as follows:

1. A clamp device to hold building trusses in place after the trusses have been deposited upon a building foundation by a crane and while they are being nailed to stabilize their position prior to application of building panels thereto which comprises:

a pair of substantially identical first U-shaped strip members defined by a longitudinal base portion and a lateral portion at each end thereof, said first members being positioned spaced apart parallel to one another with their said lateral portions at each end being aligned with each other, spaced apart cross-ties fixing said first members in said position, a second U-shaped strip member similar in configuration to said first members, said second member captured between said first members by said cross-ties to move parallel thereto with the lateral portions of said second member projecting from the same side of said device as said lateral portions of said first members, lateral posts extending laterally of each of said first members and said second member from the sides thereof opposite to their lateral portions, said lateral posts of said first members lying in a common plane normal to the longitudinal axes of said first members, said lateral post of said second member being spaced apart from said lateral posts of said first members, a lever arm having a free end and a captured end, said lever arm being pivoted adjacent said captured end on a shaft that extends between said lateral posts of said first members, and a pair of cam elements pivoted at one end to the captured end of said lever arm and at the other end to said lateral post of said second member.

2. The device of claim 1 wherein the free ends said lateral portions of said first members flair away from the free end of the respective lateral portion of said second member.

3. The device of claim 1 wherein said first and second members are made of strap steel.

4. The device of claim 3 wherein said cross-ties are made of strap steel and are welded to said first members.

5. The device of claim 1 wherein:

there are two pairs of said cross-ties, one pair of which has central holes therein, there is a hole in said second strap member which mates with said central holes where said clamp device is in a truss holding position, and there is a pin attached to said clamp device in a manner to permit said pin to be inserted through said mated holes in said cross-ties and said second strap member.

* * * * *